United States Patent [19]

Kikuchi et al.

[11] 4,145,965

[45] Mar. 27, 1979

[54] ROLLERS FOR FIXING A DEVELOPED IMAGE IN AN ELECTROPHOTOGRAPHIC COPYING MACHINE

[75] Inventors: Masayuki Kikuchi, Nara; Susumu Houjyo, Kashihara, both of Japan

[73] Assignee: Sharp Kabushiki Kaisha, Osaka, Japan

[21] Appl. No.: 791,314

[22] Filed: Apr. 27, 1977

[30] Foreign Application Priority Data

Apr. 27, 1976 [JP] Japan ..... 51/5418[U]

[51] Int. Cl.[2] ..... B30B 3/04

[52] U.S. Cl. ..... 100/176

[58] Field of Search ..... 100/176, 164, 168; 226/181-192; 242/57.1; 26/99

[56] References Cited

U.S. PATENT DOCUMENTS

| | | | |
|---|---|---|---|
| 3,691,940 | 9/1972 | Hays et al. | 100/41 |
| 3,776,628 | 12/1973 | Gundlach | 355/3 P |
| 3,931,793 | 1/1976 | Kolibas | 100/176 |
| 3,990,391 | 11/1976 | Singh | 100/176 |

*Primary Examiner*—Leonard D. Christian

*Attorney, Agent, or Firm*—Birch, Stewart, Kolasch & Birch

[57] ABSTRACT

A pair of metal rollers to which a predetermined pressure is applied are provided in an electrophotographic copying machine for fixing a developed image carried on a copy paper driven to travel through said pair of metal rollers. At least one of said rollers is slightly inclined with respect to a line perpendicular to a transportation direction of the copy paper in order to stabilize the fixing operation. In a preferred form, both of said rollers are slightly inclined in counter directions to each other with respect to the line perpendicular to the transportation direction of the copy paper.

8 Claims, 4 Drawing Figures

ROLLERS FOR FIXING A DEVELOPED IMAGE IN AN ELECTROPHOTOGRAPHIC COPYING MACHINE

BACKGROUND AND SUMMARY OF THE INVENTION

The present invention relates to fixing rollers employed within an electrophotographic copying machine.

In a certain type of electrophotographic copying machine, a developed image carried on a copy paper is fixed while the copy paper is driven to travel through a pair of fixing rollers to which a predetermined pressure is applied. It is necessary that a predetermined uniform pressure be created along the longitudinal axes of the fixing rollers in order to stabilize the fixing operation.

Accordingly, an object of the present invention is to provide a pair of fixing rollers in an electrophotographic copying machine for fixing a developed image carried on a copy paper which is driven to travel through the pair of fixing rollers.

Another object of the present invention is to stabilize the fixing operation conducted by a pair of fixing rollers in an electrophotographic copying machine.

Still another object of the present invention is to create a predetermined uniform pressure along longitudinal axes of a pair of fixing rollers employed within an electrophotographic copying machine.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects pursuant to an embodiment of the present invention, at least one of said pair of fixing rollers is slightly inclined with respect to a line perpendicular to a transportation direction of the copy paper in order to stabilize the fixing operation. In a preferred form, both of the fixing rollers are slightly inclined in counter directions to each other with respect to the line perpendicular to the transportation direction of the copy paper.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
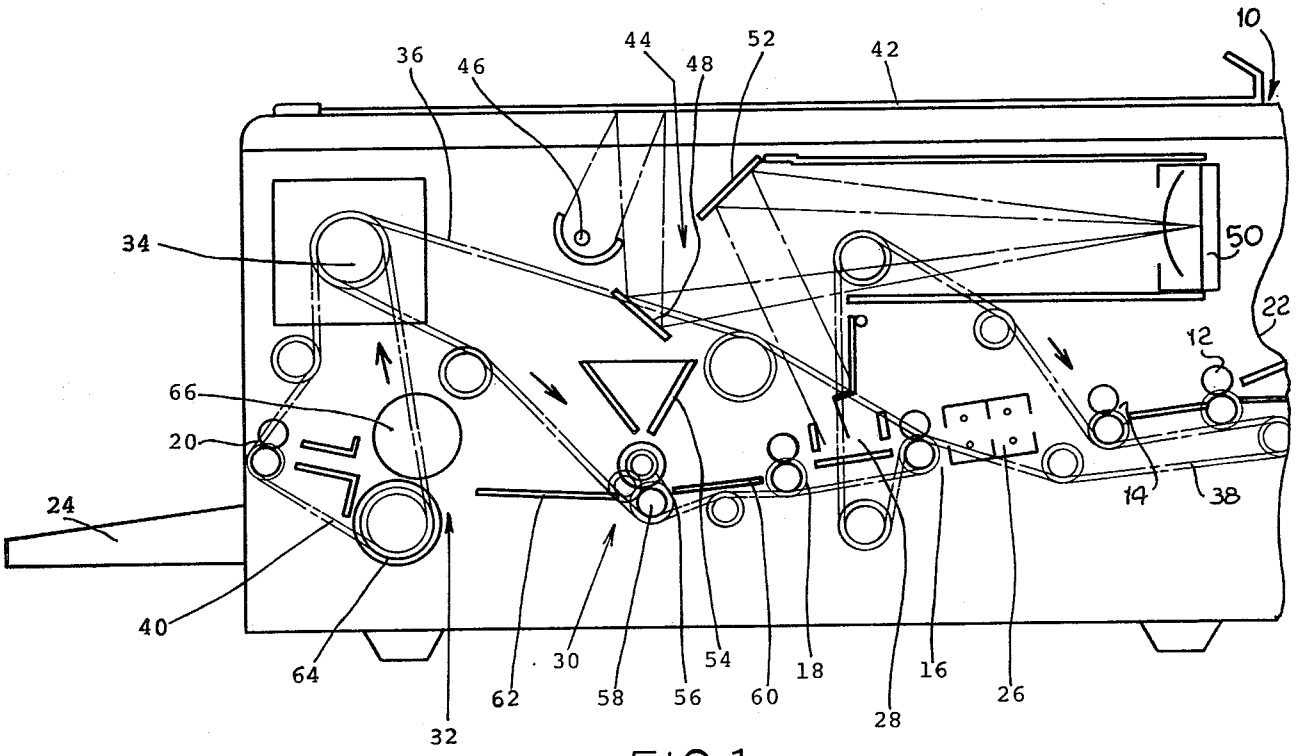
FIG. 1 is a sectional view of an electrophotographic copying machine employing an embodiment of fixing rollers of the present invention.

FIG. 1 shows an electrophotographic copying machine employing an embodiment of fixing rollers of the present invention.

The electrophotographic copying machine 10 includes paper feeding rollers 12, 14, 16, 18 and 20 for transporting a copy paper from a paper entrance 22 to a paper tray 24 through a charging section 26, an exposure section 28, a developing section 30 and a fixing section 32. The paper feeding rollers 12, 14, 16, 18 and 20 are driven to rotate by a motor 34 via transferring means 36, 38 and 40 such as chains.

The electrophotographic copying machine 10 further includes an original carrier 42, which is driven to reciprocate on the electrophotographic copying machine 10. An electrostatic latent image of an original carried on the original carrier 42 is formed on the copy paper at the exposure section 28 through the use of an exposure mechanism 44 including a lamp 46 and mirror assemblies 48, 50 and 52.

The copy paper carrying the thus formed electrostatic latent image is transported to the developing section 30. The developing section 30 comprises a toner tank 54 for containing toner particles therein, a magnet roller 56 for supplying the toner particles from the toner tank 54 to the copy paper, a guide roller 58 for transporting the copy paper, and guide plates 60 and 62 for supporting the copy paper.

The copy paper carrying the developed image thereon is transported to the fixing section 32 of the present invention. The fixing section 32 mainly comprises a pair of fixing rollers 64 and 66 to which a predetermined pressure is applied. The fixing roller 64 is driven to rotate by the motor 34, and the fixing roller 66 is rotatably supported in such a manner to rotate in unison with the revolution of the fixing roller 64. The copy paper is driven to travel through the pair of fixing rollers 64 and 66, whereby the developed image is fixed by the pressure applied to the pair of fixing rollers 64 and 66.

Figure 2:
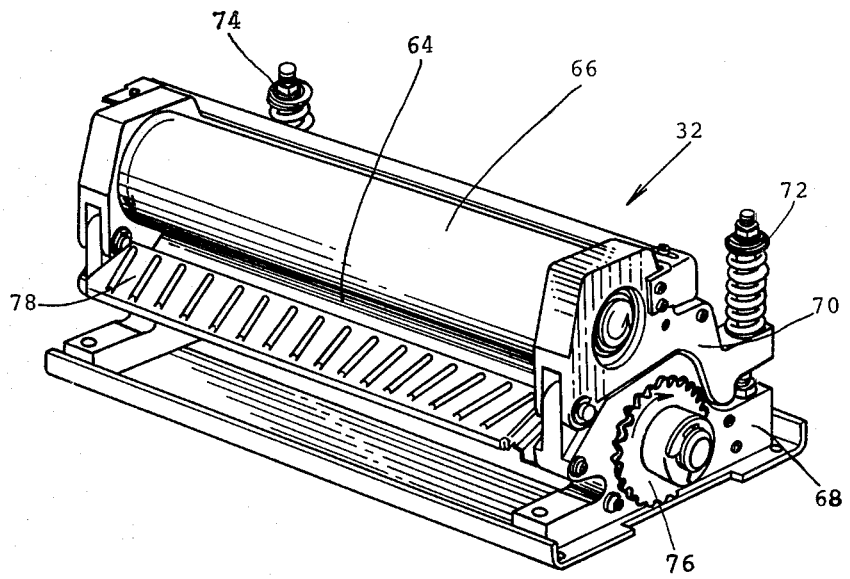
FIG. 2 is a perspective view of an embodiment of the fixing rollers of the present invention.

FIG. 2 shows a detailed construction of the fixing section 32 of the present invention. The fixing rollers 64 and 66 are cylinders made of hardened steel and have the length of 270 millimeters. The fixing rollers 64 and 66 are rotatably supported by roller holders 68 and 70 to which a predetermined pressure is applied through the use of springs 72 and 74. In a preferred form, a pressure of around 30kg/cm is created between the pair of fixing rollers 64 and 66 by the springs 72 and 74. The fixing roller 64 is driven to rotate by the motor 34 (see FIG. 1) via the chain 40 (see FIG. 1) and a sprocket wheel 76. A guide plate 78 is provided in front of the pair of fixing rollers 64 and 66 to guide the copy paper carrying the developed image thereon. A peripheral speed of the fixing roller 64 is controlled so as to equal that of the paper feeding rollers 12, 14, 16, 18 and 20.

It is very important that a predetermined and uniform pressure is created along the axes of the fixing rollers 64 and 66 to ensure stable fixing operation.

Figure 3:
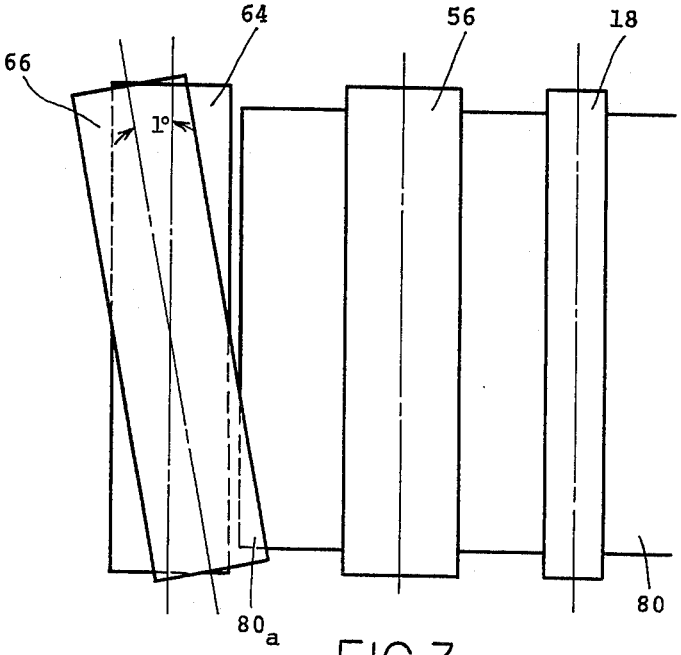
FIG. 3 is a plan view showing an arrangement of an embodiment of the fixing rollers of the present invention.

FIG. 3 shows an example an arrangement of the fixing rollers 64 and 66 to create a predetermined and uniform pressure along the axes of the fixing rollers 64 and 66. In this example, the fixing roller 66 is inclined by an angle of one degree (1°) with respect to a line perpendicular to a transportation direction of a copy paper 80. The uniform pressure can be created between the pair of fixing rollers 64 and 66 along the axes thereof by inclining the fixing roller 66.

Referring again to FIG. 1, the magnet roller 56 and the guide roller 58 are arranged so that the magnet roller 56 is spaced apart from the copy paper surface by 0.7 through 1.0 millimeters. It is important that the space provided between the copy paper surface and the magnet roller 56 is maintained at a fixed value to obtain a clean copy.

In the example of FIG. 3, there is a possibility that crimps are formed on the copy paper 80 during the transportation operation, since one edge 80*a* of the copy paper 80 is first caught by the pair of fixing rollers 64 and 66. This means that the space provided between the copy paper and the magnet roller 56 unavoidably varies.

Figure 4:
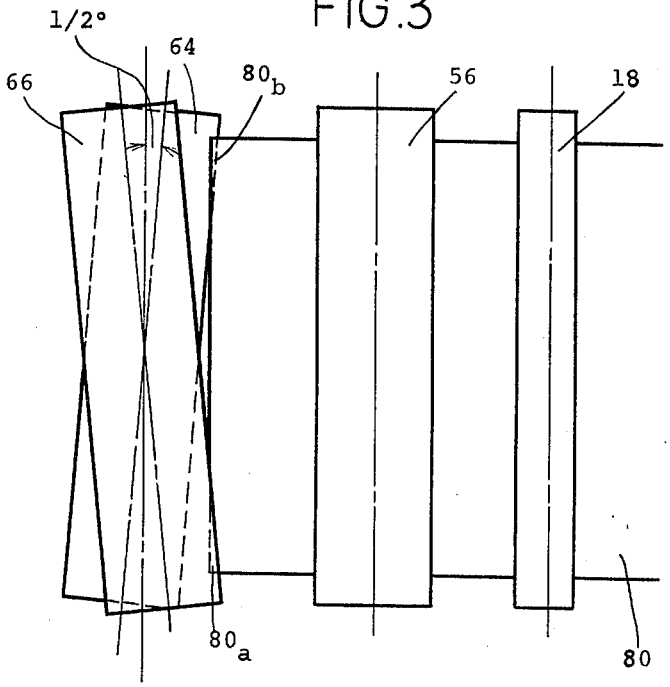
FIG. 4 is a plan view showing an arrangement of another embodiment of the fixing rollers of the present invention.

FIG. 4 shows another example of an arrangement of the fixing rollers 64 and 66, which ensures the stable fixing and the stable developing operation. Like elements corresponding to those of FIG. 3 are indicated by like numerals.

In this example, the fixing rollers 64 and 66 are inclined in counter directions to each other by an angle of a half degrees (½°) with respect to the line perpendicular to the transportation direction of the copy paper 80, respectively. Both ends 80*a* and 80*b* of the copy paper 80 are simultaneously caught by the fixing rollers 64 and 66 and, therefore, the crimps are not formed on the copy paper 80. Moreover, the predetermined and uniform pressure is created between the pair of fixing rollers 64 and 66.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electrophotographic copying machine wherein a developed image carried on a copy paper is fixed while the copy paper travels through a fixing section, said fixing section comprising:

a pair of cylinder shaped fixing rollers at least one of which is slightly inclined with respect to a line perpendicular to a travel direction of the copy paper by a fixed angle;

a stationary housing for rotatably supporting one of said pair of cylinder shaped fixing rollers;

drive means for rotating said one of the fixing rollers at a predetermined velocity;

a movable housing for rotatably supporting the other cylinder shaped fixing roller, said movable housing being rotatable around one end thereof with respect to said stationary housing in such a manner to vary the distance between said pair of fixing rollers; and depression means provided at the other end of said movable housing for creating a predetermined pressure between said pair of cylinder shaped fixing rollers, wherein the copy paper is driven to travel through said pair of fixing rollers.

2. The electrophotographic copying machine of claim 1, wherein the predetermined pressure is about 30kg/cm.

3. The electrophotographic copying machine of claim 1, wherein the first and second cylinder shaped rollers are made of hardened steel.

4. An electrophotographic copying machine wherein a developed image carried on a copy paper is fixed while the copy paper travels through a fixing section, said fixing section comprising:

a first cylinder shaped roller;

means for rotatably supporting the first cylinder shaped roller in such a manner that an axis of the first cylinder shaped roller is slightly inclined with respect to a line perpendicular to a travel direction of the copy paper by a fixed angle;

means for rotating the first cylinder shaped roller at a constant velocity;

a second cylinder shaped roller confronting said first cylinder shaped roller;

means for rotatably supporting the second cylinder shaped roller in such a manner that an axis of the second cylinder shaped roller is slightly inclined with respect to the line perpendicular to the travel direction of the copy paper by a fixed angle in the counter direction to the first cylinder shaped roller; and means for depressing the second cylinder shaped roller to the first cylinder shaped roller at a predetermined pressure.

5. The electrophotographic copying machine of claim 4, wherein the first and second cylinder shaped rollers are inclined by the same angle with respect to the line perpendicular to the travel direction of the copy paper in the counter directions to each other.

6. The electrophotographic copying machine of claim 5, wherein the first and second cylinder shaped rollers are inclined in the counter directions to each other by an angle of a half degrees (½°) with respect to the line perpendicular to the travel direction of the copy paper, respectively.

7. The electrophotographic copying machine of claim 4, wherein the predetermined pressure is about 30kg/cm.

8. The electrophotographic copying machine of claim 4, wherein the first and second cylinder shaped rollers are made of hardened steel.

* * * * *

UNITED STATES PATENT AND TRADEMARK OFFICE

CERTIFICATE OF CORRECTION

PATENT NO. : 4,145,965

DATED : March 27, 1979

INVENTOR(S) : Masayuki KIKUCHI et al

It is certified that error appears in the above-identified patent and that said Letters Patent are hereby corrected as shown below:

IN THE HEADING:

Change the Foreign Application Priority Data from "Japan 51/5418[U]" to --Japan 51/54184--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*